US010678160B2

(12) United States Patent
Suzuki

(10) Patent No.: US 10,678,160 B2
(45) Date of Patent: Jun. 9, 2020

(54) DEVELOPING ROLLER

(71) Applicant: SUMITOMO RUBBER INDUSTRIES, LTD., Hyogo (JP)

(72) Inventor: Daijiro Suzuki, Hyogo (JP)

(73) Assignee: SUMITOMO RUBBER INDUSTRIES, LTD., Hyogo (JP)

( * ) Notice: Subject to any disclaimer, the term of this patent is extended or adjusted under 35 U.S.C. 154(b) by 0 days.

(21) Appl. No.: 16/406,028

(22) Filed: May 8, 2019

(65) Prior Publication Data

US 2019/0369524 A1 Dec. 5, 2019

(30) Foreign Application Priority Data

Jun. 5, 2018 (JP) ..... 2018-107712

(51) Int. Cl.
*G03G 15/08* (2006.01)

(52) U.S. Cl.
CPC ..... *G03G 15/0808* (2013.01)

(58) Field of Classification Search
CPC ..... G03G 15/0808; G03G 15/0818; G03G 2215/0861
See application file for complete search history.

(56) References Cited

U.S. PATENT DOCUMENTS 5,597,652 A * 1/1997 Utsunomiya ..... G03G 15/0233 428/340
2014/0199098 A1* 7/2014 Abe ..... G03G 15/0818 399/279

FOREIGN PATENT DOCUMENTS

JP 2016095455 5/2016

* cited by examiner

*Primary Examiner* — Sandra Brase
(74) *Attorney, Agent, or Firm* — JCIP Global Inc.

(57) ABSTRACT

A developing roller has a roller main body including a cylindrical inner layer constituted by an elastic material and an outer layer constituted by a crosslinked product of a rubber composition in which an epichlorohydrin rubber, a nonpolar diene rubber, and LIR are included, and polar diene rubbers are not included or polar diene rubbers are included in a proportion of less than 20 parts by mass with respect to 100 parts by mass of the total amount of the rubbers, and carbon black is not included or carbon black having an amount of iodine absorbed of 40 mg/g or less is included in a proportion of less than 10 parts by mass with respect to 100 parts by mass of the total amount of the rubbers.

11 Claims, 1 Drawing Sheet

DEVELOPING ROLLER

CROSS-REFERENCE TO RELATED APPLICATION

This application claims the priority of Japan patent application serial no. 2018-107712, filed on Jun. 5, 2018. The entirety of the above-mentioned patent application is hereby incorporated by reference herein and made a part of this specification.

BACKGROUND

Technical Field

The disclosure relates to a developing roller that is used by being incorporated into an image forming device using electrophotography.

Description of Related Art

Recently, use of a roller main body of a developing roller having a 2-layer structure including a cylindrical inner layer constituted by an elastic material and an outer layer that is laminated on the outer circumferential surface of the inner layer and is constituted by an elastic material has been studied (refer to Patent Document 1 and the like).

In the developing roller described in Patent Document 1, the outer layer is formed of a crosslinked product of a rubber composition including acrylonitrile butadiene rubber (NBR), an epichlorohydrin rubber, and carbon black.

Incidentally, with the developing roller including such an outer layer, the image density of a black solid part tends to gradually decrease as image formation is repeated.

[Patent Document 1] Japanese Patent Laid-Open No. 2016-95455

The disclosure provides a developing roller which has a 2-layer structure including an inner layer and an outer layer, and does not cause a gradual decrease in the image density of particularly a black solid part even if image formation is repeated.

SUMMARY

According to an embodiment of the disclosure, there is provided a developing roller including a roller main body, wherein the roller main body includes a cylindrical inner layer constituted by an elastic material and an outer layer constituted by an elastic material laminated on the outer circumferential surface of the inner layer, and wherein the outer layer is constituted by a crosslinked product of a rubber composition in which an epichlorohydrin rubber, a nonpolar diene rubber, and a liquid isoprene rubber (LIR) are included as rubbers, and polar diene rubbers are not included or polar diene rubbers are included in a proportion of less than 20 parts by mass with respect to 100 parts by mass of the total amount of the rubbers, and carbon black is not included or carbon black having an amount of iodine absorbed of 40 mg/g or less is included in a proportion of less than 10 parts by mass with respect to 100 parts by mass of the total amount of the rubbers.

BRIEF DESCRIPTION OF THE DRAWINGS

According to the disclosure, it is possible to provide a developing roller which has a 2-layer structure including an inner layer and an outer layer, and does not cause a gradual decrease in the image density of particularly a black solid part even if image formation is repeated.

DESCRIPTION OF THE EMBODIMENTS

Figure 1A:
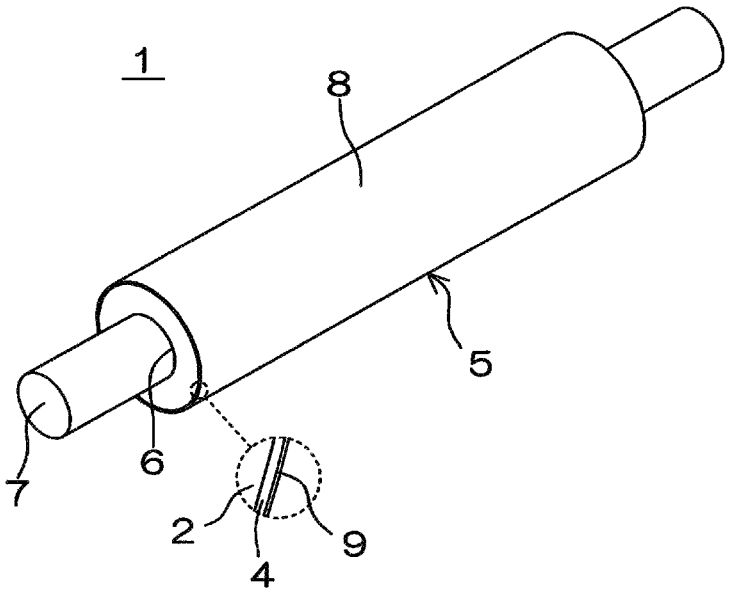
FIG. 1A is a perspective view showing an overall appearance of an example of a developing roller of the disclosure.

As described above, the developing roller of the disclosure includes a roller main body, wherein the roller main body includes a cylindrical inner layer constituted by an elastic material and an outer layer constituted by an elastic material laminated on the outer circumferential surface of the inner layer, wherein the outer layer is constituted by a crosslinked product of a rubber composition in which an epichlorohydrin rubber, a nonpolar diene rubber, and LIR are included as rubbers, polar diene rubbers are not included or polar diene rubbers are included in a proportion of less than 20 parts by mass with respect to 100 parts by mass of the total amount of the rubbers, and carbon black is not included or carbon black having an amount of iodine absorbed of 40 mg/g or less is included in a proportion of less than 10 parts by mass with respect to 100 parts by mass of the total amount of the rubbers.

When image formation is repeated using a developing roller having a 2-layer structure of the related art, a decrease in image density of a black solid part, that is, a decrease in the durable image density, occurs like that described in Patent Document 1. The reason for this is due to carbon black contained in the outer layer and polar diene rubbers such as NBR.

In addition, when carbon black has a larger specific surface area or has a larger proportion with respect to rubber, it tends to lower the durable image density.

On the other hand, according to the disclosure, carbon black is not added at all (excluded), or even if it is added, a small amount of carbon black having an amount of iodine absorbed that is in the above range and having a small specific surface area is added in the above proportion, and thus it is possible to minimize a decrease in the durable image density.

In addition, regarding the rubber, polar diene rubbers such as NBR are not added at all (excluded), or even if they are added, a small amount thereof is added in a proportion of less than 20 parts by mass with respect to 100 parts by mass of the total amount of the rubbers.

In addition, when nonpolar diene rubbers such as isoprene rubber (IR), butadiene rubber (BR), and styrene butadiene rubber (SBR) are used with respect to the remaining amount of rubber, it is possible to further minimize a decrease in the durable image density.

However, a rubber composition in which carbon black is not included or only a small amount thereof is included has poor processability.

Then, for example, when the rubber composition is extruded and molded into a cylindrical component that forms the outer layer, the extruded surface of the extruded and molded cylindrical component may become rough, and irregularities may occur on the outer circumferential surface of the cylindrical component and the inner circumferential surface of a through-hole.

For example, even if an outer circumferential surface having irregularities is polished and finished in a predetermined surface state, traces of the irregularities may remain, which may cause image defects in formed images.

In addition, when irregularities occur on the inner circumferential surface, poor bonding to the inner layer and the like may be caused. On the other hand, according to the disclosure, when an LIR functioning as a processing aid for a rubber composition with a low molecular weight before crosslinking is used, it is possible to improve the processability of the rubber composition, for example, it is possible to minimize the occurrence of irregularities on the outer circumferential surface of the cylindrical component and the inner circumferential surface of the through-hole.

This can be clearly understood from the results of examples and comparative examples to be described below.

Figure 1B:
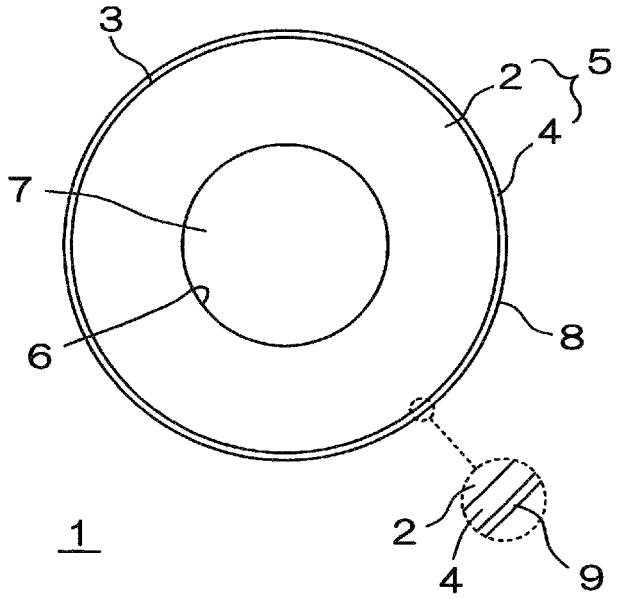
FIG. 1B is an end view of the developing roller of the above example.

FIG. 1A is a perspective view showing an overall appearance of an example of a developing roller of the disclosure, and FIG. 1B is an end view of the developing roller of the above example.

Referring to FIGS. 1A and 1B, a developing roller 1 of this example includes a roller main body 5 having a 2-layer structure in which an outer layer 4 constituted by an elastic material is directly laminated on an outer circumferential surface 3 of a cylindrical inner layer 2 constituted by an elastic material.

A shaft 7 is inserted into and fixed to a through-hole 6 at the center of the inner layer 2.

The shaft 7 is integrally formed of a highly conductive material, for example, a metal such as iron, aluminum, an aluminum alloy, or stainless steel.

For example, the shaft 7 is electrically connected and mechanically fixed to the roller main body 5 using an adhesive having conductivity, or a shaft having an outer diameter larger than the inner diameter of the through-hole 6 is press-fitted into the through-hole 6 so that the shaft is electrically connected and mechanically fixed to the roller main body 5.

In addition, using both methods together, the shaft 7 may be electrically connected and mechanically fixed to the roller main body 5.

As shown in the enlarged parts in both drawings, an oxide film 9 is formed on the surface of the outer layer 4, that is, an outer circumferential surface 8 of the roller main body 5.

When the oxide film 9 is formed, the oxide film 9 can function as a dielectric layer and a dielectric loss tangent of the developing roller 1 can be reduced, and the oxide film 9 can function as a low-friction layer, and it is possible to favorably minimize adhesion of a toner.

Moreover, since the oxide film 9 can be easily formed, for example, by simply oxidizing rubber in the vicinity of the outer circumferential surface 8 by emitting ultraviolet rays to the outer circumferential surface 8 in an oxidizing atmosphere, it is possible to minimize a decrease in the productivity of the developing roller 1 and an increase in production costs.

However, the oxide film 9 may be omitted.

In order to simplify structures of the inner layer 2 and the outer layer 4 and improve durability, and the like, it is preferable that each of the layers be formed as a nonporous single layer.

Here, the "single layer" for the outer layer 4 means that the number of layers constituted by an elastic material is one.

In addition, "2-layer" with respect to the roller main body 5 means that the number of layers constituted by an elastic material like the inner layer 2 and the outer layer 4 is two, and in any case, the oxide film 9 formed by emitting ultraviolet rays and the like is not included in the number of layers.

<<Rubber Composition for Outer Layer 4>>

As the rubber composition for the outer layer 4, as described above, a rubber composition in which an epichlorohydrin rubber, a nonpolar diene rubber, and LIR are included as rubbers, polar diene rubbers are not included or polar diene rubbers are included in a proportion of less than 20 parts by mass with respect to 100 parts by mass of the total amount of the rubbers, and carbon black is not included or carbon black having an amount of iodine absorbed of 40 mg/g or less is included in a proportion of less than 10 parts by mass with respect to 100 parts by mass of the total amount of the rubbers is used.

<Epichlorohydrin Rubber>

Examples of the epichlorohydrin rubber include an epichlorohydrin homopolymer, an epichlorohydrin-ethylene oxide binary copolymer (ECO), an epichlorohydrin-propylene oxide binary copolymer, an epichlorohydrin-allyl glycidyl ether binary copolymer, an epichlorohydrin-ethylene oxide-allyl glycidyl ether terpolymer (GECO), an epichlorohydrin-propylene oxide-allyl glycidyl ether terpolymer, and an epichlorohydrin-ethylene oxide-propylene oxide-allyl glycidyl ether quaternary copolymer.

Among these, a copolymer containing ethylene oxide, particularly, ECO and/or GECO is preferable.

Contents of ethylene oxide in ECO and/or GECO are both preferably 30 mol % or more, particularly 50 mol % or more, and preferably 80 mol % or less.

Ethylene oxide has an effect of lowering a resistance value of the outer layer 4.

However, when the content of ethylene oxide is below the above range, since the above effect is not obtained sufficiently, the resistance value of the outer layer 4 may not be sufficiently lowered.

On the other hand, when the content of ethylene oxide exceeds the above range, crystallization of ethylene oxide occurs, and segment movement of a molecular chain is inhibited, and thus a resistance value of the outer layer 4 tends to increase contrarily.

In addition, the outer layer 4 after crosslinking may then become too hard, the viscosity of the rubber composition before crosslinking may increase during heating and melting, and the processability of the rubber composition may deteriorate in some cases.

A content of epichlorohydrin in ECO is the amount remaining after the ethylene oxide content.

That is, the content of epichlorohydrin is preferably 20 mol % or more, and preferably 70 mol % or less, and particularly 50 mol % or less.

In addition, the content of allyl glycidyl ether in GECO is preferably 0.5 mol % or more, particularly 2 mol % or more, and preferably 10 mol % or less, particularly 5 mol % or less.

Allyl glycidyl ether itself functions as a side chain to secure a free volume, and thereby minimizes crystallization of ethylene oxide, and thus has an effect of lowering a resistance value of the outer layer 4.

However, when the content of allyl glycidyl ether is below the above range, since the above effect is not obtained sufficiently, a resistance value for the outer layer 4 may not be sufficiently lowered.

On the other hand, allyl glycidyl ether functions as a crosslinking point when GECO is crosslinked.

Therefore, when the content of allyl glycidyl ether exceeds the above range, a crosslinking density of GECO becomes too high, and thus segment movement of a molecular chain is inhibited, and thereby the resistance value of the outer layer 4 tends to increase contrarily.

A content of epichlorohydrin in GECO is the amount remaining after the ethylene oxide content and the allyl glycidyl ether content.

That is, the content of epichlorohydrin is preferably 10 mol % or more, particularly 19.5 mol % or more, and preferably 69.5 mol % or less, particularly 60 mol % or less.

Here, regarding the GECO, in addition to the copolymer in which three types of monomers are copolymerized described above in a narrow sense, a modified component obtained by modifying an epichlorohydrin-ethylene oxide copolymer (ECO) with allyl glycidyl ether is known.

In the disclosure, any of such GECOs can be used.

As the epichlorohydrin rubber, particularly GECO is preferable.

Since GECO has a double bond functioning as a crosslinking point in the main chain due to the allyl glycidyl ether, it is possible to reduce a compression set after crosslinking by crosslinking between main chains.

Therefore, the outer layer 4 can be made to have a small compression set and deformation is unlikely to occur therein.

One, two or more types of such epichlorohydrin rubbers can be used.

<Nonpolar Diene Rubber>

A diene rubber is used to impart favorable processability to the rubber composition, improve the mechanical strength, durability, and the like of the outer layer 4, or for the rubber to impart favorable characteristics to the outer layer 4, that is, impart flexibility and characteristics in which a compression set is small and deformation is unlikely to occur.

In addition, a diene rubber is oxidized when ultraviolet rays are emitted, and serves as a material for forming the oxide film 9 on the surface of the outer layer 4, that is, the outer circumferential surface 8 of the roller main body 5.

As a nonpolar diene rubber among diene rubbers, as described above, for example, at least one selected from the group consisting of IR, BR, and SBR can be used, and particularly SBR is preferable.

In order to finish the outer circumferential surface 8 of the outer layer 4 in a predetermined surface state as described above, in the current process, wet polishing is generally performed.

However, with IR, it may be difficult to finish the outer circumferential surface 8 such that it has a predetermined surface state even if wet polishing is performed, and BR has high abrasion resistance such that some time may be taken for wet polishing.

On the other hand, since SBR is easier to polish than IR and BR, the outer circumferential surface 8 of the outer layer 4 can be finished to a predetermined surface state with high efficiency according to wet polishing in a short time therewith.

In addition, the epichlorohydrin rubber is a polar rubber which also causes a decrease in the durable image density. However, it is possible to reduce the proportion of the epichlorohydrin rubber necessary for adjusting the resistance value of the outer layer 4 to a predetermined range in a system in combination with SBR, compared to a system in combination with IR or BR.

Thereby, it is possible to minimize a decrease in the durable image density with higher efficiency.

(SBR)

Regarding the SBR, any of various SBRs which are synthesized by copolymerizing styrene and 1,3-butadiene according to various polymerization methods such as an emulsion polymerization method and a solution polymerization method, and have crosslinking properties can be used.

In addition, regarding the SBRs, there are a high styrene type, medium styrene type, and low styrene type SBRs classified according to a content of styrene, and any of them can be used.

Particularly, an SBR having a Mooney viscosity $ML_{1+4}$ (100° C.) of 60 or less is preferable.

In addition, regarding the SBRs, there are an oil-extended type in which an extender oil is added to adjust flexibility and a non-oil-extended type in which no extender oil is added. However, in the disclosure, in order to prevent contamination of the photoreceptor and the like, an SBR of a non-oil-extended type not containing an extender oil which may serve as a bleeding material is preferably used.

One, two, or more types of such SBRs can be used.

(IR)

Regarding the IR, any of various IRs having a polyisoprene structure in which a natural rubber structure is artificially reproduced and which has crosslinking properties, and is in a solid state at room temperature before crosslinking can be used.

In addition, regarding the IRs, there are an oil-extended type in which an extender oil is added to adjust flexibility and a non-oil-extended type in which no extender oil is added. However, in the disclosure, in order also to prevent contamination of the photoreceptor, an IR of a non-oil-extended type not containing an extender oil which may serve as a bleeding material is preferably used.

One, two, or more types of such IRs can be used.

(BR)

Regarding the BR, any of various BRs having a polybutadiene structure in the molecule and having crosslinking properties can be used.

Particularly, a high cis BR having a cis-1,4 bond content of 95% or more which can exhibit favorable characteristics as a rubber in a wide temperature range from a low temperature to a high temperature is preferable.

In addition, regarding the BRs, there are an oil-extended type in which an extender oil is added to adjust flexibility and a non-oil-extended type in which no extender oil is added. However, in the disclosure, in order also to prevent contamination of the photoreceptor, a BR of a non-oil-extended type not containing an extender oil which may serve as a bleeding material is preferably used.

One, two, or more types of such BRs can be used.

<LIR>

As described above, an LIR with a low molecular weight functions as a processing aid for the rubber composition before crosslinking. Therefore, when an LIR is added, it is possible to improve the processability of the rubber composition, and minimize the occurrence of irregularities, for example, on the outer circumferential surface of the cylindrical component and the inner circumferential surface of the through-hole.

Moreover, when the rubber composition is molded into the shape of the outer layer and crosslinked, since the LIR is crosslinked with the rubber, and incorporated into a crosslinked product, it is possible to minimize bleeding to the outer circumferential surface of the outer layer and contamination of the photoreceptor and the like.

Regarding the LIR, any of various LIRs which are a liquid at room temperature before crosslinking and have crosslinking properties can be used.

Particularly, an LIR having a number average molecular weight Mn of 28,000 or more and 58,000 or less is preferably used.

An LIR having a number average molecular weight Mn that is below the above range has a very low viscosity, and it may be difficult to knead with an epichlorohydrin rubber and a nonpolar diene rubber.

Therefore, such an effect of improving the processability of the rubber composition by making LIR function as a processing aid may not be obtained sufficiently.

In addition, an amount of LIR remaining in the roller main body in a relatively low molecular weight state after crosslinking increases, and the LIR may bleed to the outer circumferential surface of the outer layer 4 and cause contamination of the photoreceptor.

On the other hand, since LIR having a number average molecular weight Mn that exceeds the above range has a very large viscosity and is in a state that can hardly be called a liquid state at room temperature, such an effect of improving the processability of the rubber composition by making LIR function as a processing aid may not be obtained sufficiently.

On the other hand, when LIR having a number average molecular weight Mn that is in the above range is selected and used, it is possible to further improve the processability of the rubber composition while minimizing contamination of the photoreceptor due to bleeding.

Here, LIR is classified as a nonpolar diene rubber. However, in the disclosure, a function as the processing aid is given importance and LIR is treated differently from other nonpolar diene rubbers.

<Polar Diene Rubber>

Regarding the rubber, additionally, a polar diene rubber such as an NBR and a CR may be added.

The polar diene rubber cannot be added in a large amount because it reduces durable image density. However, when a small amount thereof is added as described above, it functions to finely adjust the resistance value of the outer layer 4.

(NBR)

Regarding the NBR, any of a low nitrile NBR having an acrylonitrile content of 24% or less, medium nitrile NBR having an acrylonitrile content of 25 to 30%, medium to high nitrile NBR having an acrylonitrile content of 31 to 35%, high nitrile NBR having an acrylonitrile content of 36 to 42%, and extremely high nitrile NBR having an acrylonitrile content of 43% or more can be used.

In addition, as NBR, there are an oil-extended type in which an extender oil is added to adjust the flexibility and a non-oil-extended type in which no extender oil is added. In the disclosure, in order to prevent contamination of the photoreceptor and the like, NBR of a non-oil-extended type not containing an extender oil which may serve as a bleeding material is preferably used.

One, two, or more types of such NBRs can be used.

(CR)

CRs are synthesized by emulsion polymerization of chloroprene, and are classified into sulfur-modified types and non-sulfur-modified types according to the type of the molecular weight adjusting agent used for the synthesis.

Among these, the sulfur-modified type CR is synthesized by plasticizing a polymer obtained by copolymerizing chloroprene and sulfur as a molecular weight adjusting agent with thiuram disulfide or the like and adjusting the viscosity to a predetermined degree.

In addition, the non-sulfur-modified type CRs are classified into, for example, mercaptan-modified types, xanthogen-modified types, and the like.

Among these, the mercaptan-modified type CR is synthesized in the same manner as in the sulfur-modified type CR except that alkyl mercaptans such as n-dodecyl mercaptan, tert-dodecyl mercaptan, and octyl mercaptan are used as a molecular weight adjusting agent.

In addition, the xanthogen-modified type CR is synthesized in the same manner as in the sulfur-modified type CR except that an alkylxanthogen compound is used as a molecular weight adjusting agent.

In addition, CRs are classified into slow crystallization rate types, moderate crystallization rate types, and fast crystallization rate types based on its crystallization rate.

In the disclosure, any type of CR may be used. However, among these, non-sulfur-modified type and slow crystallization rate type CR is preferable.

In addition, regarding the CR, a copolymer of chloroprene and another copolymer component may be used. Examples of the other copolymer component include one, two, or more types from 2,3-dichloro-1,3-butadiene, 1-chloro-1,3-butadiene, styrene, acrylonitrile, methacrylonitrile, isoprene, butadiene, acrylic acid, acrylate ester, methacrylic acid, and methacrylic acid ester.

In addition, as CR, there are an oil-extended type in which an extender oil is added to adjust flexibility and a non-oil-extended type in which no extender oil is added. However, in the disclosure, in order also to prevent contamination of the photoreceptor, CR of a non-oil-extended type not containing an extender oil which may serve as a bleeding material is preferably used.

One, two, or more types of such CRs can be used.

<Proportion of Rubber>

The proportion of rubber can be arbitrarily set according to various characteristics required for the outer layer 4, particularly durable image density, the resistance value, flexibility, and the like.

However, in order to adjust the resistance value of the outer layer 4 to be within a range suitable for the outer layer 4 and minimize a decrease in the durable image density, the proportion of the epichlorohydrin rubber is preferably 20 parts by mass or more and preferably 40 parts by mass or less with respect to 100 parts by mass of the total amount of the rubbers.

In addition, the proportion of the LIR is preferably 5 parts by mass or more, particularly 7 parts by mass or more, and preferably 15 parts by mass or less, particularly 12 parts by mass or less with respect to 100 parts by mass of the total amount of the rubbers.

When the proportion of the LIR is set to be within the above range, it is possible to improve the processability of the rubber composition before crosslinking while reducing an increase in the amount of LIR remaining in the roller main body in a relatively low molecular weight state after crosslinking.

As described above, a polar diene rubber is not added at all (excluded), or even if it is added, it needs to be added in a range of less than 20 parts by mass with respect to 100 parts by mass of the total amount of the rubbers.

The reason for this is as described above.

That is, when the proportion of the polar diene rubber is 20 parts by mass or more with respect to 100 parts by mass of the total amount of the rubbers, the durable image density decreases greatly.

On the other hand, the polar diene rubber is not added or is added in a proportion of less than 20 parts by mass with respect to 100 parts by mass of the total amount of the rubbers, and thus it is possible to minimize a decrease in the durable image density.

Here, in order to further improve such effects, the proportion of the polar diene rubber is preferably 10 parts by mass or less within the above range.

In addition, in order for the effects resulting from addition of the polar diene rubber to be suitably exhibited, the proportion of the polar diene rubber is preferably 1 part by mass or more within the above range with respect to 100 parts by mass of the total amount of the rubbers.

However, in the disclosure, as described above, no polar diene rubber is added, that is, the proportion of the polar diene rubber is in a range of up to 0 parts by mass with respect to 100 parts by mass of the total amount of the rubbers.

The proportion of the nonpolar diene rubber is the amount remaining after the epichlorohydrin rubber and LIR, or the amount remaining after the epichlorohydrin rubber, LIR, and polar diene rubber.

That is, the proportion of the nonpolar diene rubber may be set so that the total amount of the rubbers is 100 parts by mass when the proportion of the epichlorohydrin rubber and LIR, or the proportion of the epichlorohydrin rubber, LIR, and polar diene rubber is set to have predetermined values within the above range.

Here, when two or more types from epichlorohydrin rubbers, LIR, nonpolar diene rubbers, or polar diene rubbers are used in combination, the above proportion is a total proportion of the above two or more types of rubbers used in combination.

<Carbon Black>

As described above, carbon black is not added at all (excluded), or even if it is added, carbon black having an amount of iodine absorbed of 40 mg/g or less needs to be added in a range of less than 10 parts by mass with respect to 100 parts by mass of the total amount of the rubbers.

The reason for this is as described above.

That is, even if carbon black having an amount of iodine absorbed of greater than 40 mg/g and a large specific surface area is added in a small amount, the durable image density is greatly reduced.

In addition, when the proportion of carbon black having an amount of iodine absorbed of 40 mg/g or less is 10 parts by mass or more with respect to 100 parts by mass of the total amount of the rubbers, the durable image density decreases also decreases greatly.

On the other hand, no carbon black is added or carbon black having an amount of iodine absorbed of 40 mg/g or less is added in a proportion of less than 10 parts by mass with respect to 100 parts by mass of the total amount of the rubbers, and thus it is possible to minimize a decrease in the durable image density.

Here, in order to further improve such effects, an amount of iodine absorbed of carbon black is preferably 10 mg/g or more and preferably 30 mg/g or less within the above range.

In addition, the proportion of carbon black having an amount of iodine absorbed of 40 mg/g or less is preferably 5 parts by mass or less with respect to 100 parts by mass of the total amount of the rubbers.

In addition, in order for the effects resulting from addition of carbon black having an amount of iodine absorbed of 40 mg/g or less to be suitably exhibited, the proportion of the carbon black is preferably 1 part by mass or more within the above range with respect to 100 parts by mass of the total amount of the rubbers.

However, in the disclosure, as described above, no carbon black is added, that is, the proportion of carbon black having an amount of iodine absorbed of 40 mg/g or less is in a range of up to 0 parts by mass with respect to 100 parts by mass of the total amount of the rubbers. Examples of the carbon black having an amount of iodine absorbed of 40 mg/g or less include one, two, or more types from Asahi #60U [amount of iodine absorbed: 40 mg/g], Asahi #55 [amount of iodine absorbed: 25 mg/g], Asahi #50HG [amount of iodine absorbed: 20 mg/g], Asahi #52 [amount of iodine absorbed: 19 mg/g], Asahi #51 [amount of iodine absorbed: 17 mg/g], Asahi #50U [amount of iodine absorbed: 26 mg/g], Asahi #50 [amount of iodine absorbed: 23 mg/g], Asahi #35 [amount of iodine absorbed: 23 mg/g], Asahi #22K [amount of iodine absorbed: 19 mg/g], Asahi #15HS [amount of iodine absorbed: 13 mg/g], Asahi #15 [amount of iodine absorbed: 11 mg/g], Asahi #8 [amount of iodine absorbed: 12 mg/g], and Asahi Thermal [amount of iodine absorbed: 27 mg/g], which are commercially available from Asahi Carbon Co., Ltd.

Here, if the rubber composition for the outer layer 4 which does not contain carbon black or contains carbon black in a proportion that is within the above range is combined with, for example, a standard carbon black amount of the rubber composition for the inner layer 2, it is possible to improve the visibility of both compositions due to a difference in the color intensity.

Therefore, for example, there is an advantage that adjustment and the like during co-extrusion and molding can be facilitated.

<Crosslinking Component>

A crosslinking component for crosslinking rubber is added to the rubber composition for the outer layer 4.

Regarding the crosslinking component, a crosslinking agent for crosslinking rubber and a crosslinking promoter for promoting crosslinking of rubber using the crosslinking agent are preferably used in combination.

Among these, regarding the crosslinking agent, for example, a sulfur-based crosslinking agent, a thiourea-based crosslinking agent, a triazine derivative-based crosslinking agent, a peroxide-based crosslinking agent, various monomers, and the like may be used. Particularly, a sulfur-based crosslinking agent is preferable.

(Sulfur-Based Crosslinking Agent)

Examples of the sulfur-based crosslinking agent include sulfurs such as sulfur powder, oil-treated sulfur powder, precipitated sulfur, colloidal sulfur, and dispersible sulfur and an organic-sulfur-containing compound such as tetramethylthiuram disulfide and N,N-dithiobismorpholine. Particularly, sulfur is preferable.

In order for the rubber to impart favorable characteristics to the roller main body, the proportion of sulfur is preferably 0.5 parts by mass or more and preferably 2 parts by mass or less with respect to 100 parts by mass of the total amount of the rubbers.

Here, for example, when oil-treated sulfur powder, dispersible sulfur, or the like is used as sulfur, the proportion is a proportion of sulfur itself as an active component contained therein.

In addition, when an organic-sulfur-containing compound is used as the crosslinking agent, the proportion is preferably adjusted so that the proportion of sulfur contained in molecules with respect to 100 parts by mass of the total amount of the rubbers is within the above range.

(Crosslinking Promoter)

Examples of the crosslinking promoter for promoting crosslinking of rubbers include one, two, or more types of a thiuram-based promoter, a thiazole-based promoter, a thiourea-based promoter, a guanidine-based promoter, a sulfenamide-based promoter, and a dithiocarbamate-based promoter.

Among these, it is preferable to use a thiuram-based promoter, a thiazole-based promoter, thiourea-based promoter, and a guanidine-based promoter in combination.

Examples of the thiuram-based promoter include one, two, or more types of tetramethylthiuram monosulfide, tetramethylthiuram disulfide, tetraethylthiuram disulfide, tetrabutylthiuram disulfide, and dipentamethylene thiuram tetrasulfide. Particularly, tetramethylthiuram monosulfide is preferable.

Examples of the thiazole-based promoter include one, two, or more types of 2-mercaptobenzothiazole, di-2-benzothiazolyl disulfide, a zinc salt of 2-mercaptobenzothiazole, a cyclohexylamine salt of 2-mercaptobenzothiazole, and 2-(4'-morpholinodithio)benzothiazole. Particularly, di-2-benzothiazolyl disulfide is preferable.

Regarding the thiourea-based promoter, various thiourea compounds having a thiourea structure in the molecule can be used.

Examples of the thiourea-based promoter include one, two, or more types of ethylene thiourea, N,N'-diphenylthiourea, trimethylthiourea, thiourea represented by Formula (1):

$$(C_nH_{2n+1}NH)_2C{=}S \quad (1)$$

[where, n is an integer of 1 to 12], tetramethylthiourea, and the like. Particularly, ethylene thiourea is preferable.

Examples of the guanidine-based promoter include one, two, or more types of 1,3-diphenylguanidine, 1,3-di-o-tolylguanidine, 1-o-tolyl biguanide, and the like. Particularly, 1,3-di-o-tolylguanidine is preferable.

In a system using the above four types in combination, in order to exhibit such an effect of promoting crosslinking of rubber sufficiently, the proportion of the thiuram-based promoter is preferably 0.3 parts by mass or more and preferably 1 part by mass or less with respect to 100 parts by mass of the total amount of the rubbers.

In addition, the proportion of the thiazole-based promoter is preferably 0.3 parts by mass or more and preferably 2 parts by mass or less with respect to 100 parts by mass of the total amount of the rubbers.

The proportion of the thiourea-based promoter is preferably 0.3 parts by mass or more and preferably 1 part by mass or less with respect to 100 parts by mass of the total amount of the rubbers.

In addition, the proportion of the guanidine-based promoter is preferably 0.2 parts by mass or more and preferably 1 part by mass or less with respect to 100 parts by mass of the total amount of the rubbers.

Here, the thiourea-based promoter functions as a crosslinking agent of ECO having no sulfur crosslinking properties, and the guanidine-based promoter functions as a promoter for crosslinking ECO according to the thiourea-based promoter.

<Ion Conducting Agent>

An ion conducting agent may be additionally added to the rubber composition for the outer layer 4.

When the ion conducting agent is added, it is possible to further improve ion conductivity of the rubber composition and it is possible to further reduce the resistance value of the outer layer 4 itself.

Regarding the ion conducting agent, a salt (ionic salt) of an anion having a fluoro group and a sulfonyl group in the molecule and a cation is preferable.

Examples of the anion having a fluoro group and a sulfonyl group in the molecule constituting the ionic salt include one, two, or more types of fluoroalkyl sulfonic acid ions, bis(fluoroalkylsulfonyl)imide ions, and tris(fluoroalkylsulfonyl)methide ions.

Among these, examples of the fluoroalkyl sulfonic acid ions include one, two, or more types of $CF_3SO_{3-}$, and $C_4F_9SO_{3-}$.

In addition, examples of the bis(fluoroalkylsulfonyl)imide ions include one, two, or more types of $(CF_3SO_2)_2N^+$, $(C_2F_5SO_2)_2N^-$, $(C_4F_9SO_2)(CF_3SO_2)N^-$, $(FSO_2C_6F_4)(CF_3SO_2)N^-$, $(C_8F_{17}SO_2)(CF_3SO_2)N^-$, $(CF_3CH_2OSO_2)_2N^-$, $(CF_3CF_2CH_2OS_2)_2N^-$, $(HCF_2CF_2CH_2OSO_2)_2N^-$, and $[(CF_3)_2CHOSO_2]_2N^-$.

In addition, examples of the tris(fluoroalkylsulfonyl)methide ions include one, two, or more types of $(CF_3SO_2)_3C^-$, and $(CF_3CH_2OSO_2)_3C^-$.

In addition, examples of the cation include one, two, or more types of ions of alkali metals such as sodium, lithium, and potassium, ions of elements of Group 2 such as beryllium, magnesium, calcium, strontium, and barium, ions of transition elements, cations of amphoteric elements, quaternary ammonium ions, and imidazolium cations.

Regarding the ionic salt, a lithium salt using lithium ions as cations or a potassium salt using potassium ions as cations is particularly preferable.

Among these, in order to obtain effects of improving ion conductivity of the rubber composition and reducing the resistance value of the outer layer 4, $(CF_3SO_2)_2NLi$[lithium bis(trifluoromethanesulfonyl)imide Li-TFSI], and/or $(CF_3SO_2)_2NK$[potassium bis(trifluoromethanesulfonyl) imide, K-TFSI] are preferable.

The proportion of the ion conducting agent such as an ionic salt is preferably 0.5 parts by mass or more and preferably 2 parts by mass or less with respect to 100 parts by mass of the total amount of the rubbers.

<Others>

Various additives may be additionally added to the rubber composition for the outer layer 4 as necessary.

Examples of the additive include a crosslinking promoting aid, an acid acceptor, a plasticizer, and a processing aid.

Among these, examples of the crosslinking promoting aid include one, two, or more types of metal compounds such as zinc oxide (zinc white); fatty acids such as stearic acid, oleic acid, and cotton seed fatty acid, and a crosslinking promoting aid known in the related art.

Individually, the proportion of the crosslinking promoting aid is preferably 0.1 parts by mass or more and preferably 7 parts by mass or less with respect to 100 parts by mass of the total amount of the rubbers.

The acid acceptor functions to prevent a chlorine-based gas generated from an epichlorohydrin rubber or CR during crosslinking from remaining in the outer layer 4, thereby preventing crosslinking inhibition and contamination and the like of the photoreceptor.

Regarding the acid acceptor, various substances acting as an acid acceptor can be used. Among these, hydrotalcites or magsarat having excellent dispersibility is preferable, and hydrotalcites are particularly preferable.

In addition, when hydrotalcites or the like and magnesium oxide or potassium oxide are used in combination, it is possible to obtain a stronger acid acceptor effect and it is possible to prevent contamination of the photoreceptor more reliably.

The proportion of the acid acceptor is preferably 0.1 parts by mass or more and preferably 7 parts by mass or less with respect to 100 parts by mass of the total amount of the rubbers.

Examples of the plasticizer include various plasticizers such as dibutyl phthalate, dioctyl phthalate, and tricresyl phosphate, and various waxes such as polar wax. Examples of the processing aid include fatty acid metal salts such as zinc stearate.

The proportion of the plasticizer and/or processing aid is preferably 3 parts by mass or less with respect to 100 parts by mass of the total amount of the rubbers.

In addition, regarding the additive, various additives such as a filling agent other than carbon black, a deterioration inhibitor, a scorching inhibitor, a lubricant, a pigment, an antistatic agent, a flame retardant, a neutralizing agent, a nucleating agent, and a co-crosslinking agent may be additionally added in an arbitrary proportion.

Examples of the filling agent other than carbon black include one, two, or more types of zinc oxide, silica, talc, calcium carbonate, magnesium carbonate, and aluminum hydroxide.

<Preparation of Rubber Composition>

The rubber composition for the outer layer 4 including the components described above can be prepared in the same manner as in the related art.

First, rubber is masticated. Next, components other than the crosslinking component are added and kneaded, and the crosslinking component is then finally added and kneaded to obtain a rubber composition for the outer layer 4.

For kneading, for example, a kneader, a Bunbury mixer, or an extruder can be used.

<<Rubber Composition for Inner Layer 2>>

The inner layer 2 can be formed of various elastic materials.

Particularly preferably, the inner layer 2 is formed of a crosslinked product of a rubber composition including an epichlorohydrin rubber and a diene rubber.

<Epichlorohydrin Rubber>

Regarding the epichlorohydrin rubber, one, two, or more types of epichlorohydrin rubbers the same as those used in the outer layer 4 can be used.

Among these, ECO and/or GECO is preferable, and particularly GECO is preferable.

The reason for this is the same as in the case of the outer layer 4.

That is, when GECO is used as the epichlorohydrin rubber, the inner layer 2 can be made to have a small compression set and deformation is unlikely to occur therein.

<Diene Rubber>

Diene rubber is used to impart favorable processability to the rubber composition, improve the mechanical strength, durability and the like of the inner layer 2, or for the rubber to impart favorable characteristics to the inner layer 2.

Examples of the diene rubber include natural rubber, IR, NBR, SBR, BR, and CR.

Among these, regarding the diene rubber, a nonpolar diene rubber is used, specifically it is preferable to use at least one of IR, BR, and SBR, and particularly two IR and BR in combination.

Regarding the IR, one, two, or more types of IRs the same as those used in the outer layer 4 can be used. Regarding the BR, one, two, or more types of BRs the same as those used in the outer layer 4 can be used.

In addition, regarding the diene rubber, CR may be additionally added.

As described above, since CR is a diene rubber having polarity, it functions to finely adjust the resistance value of the inner layer 2 itself.

Regarding the CR, one, two, or more types of CRs the same as those used in the outer layer 4 can be used.

(Proportion of Rubber)

The proportion of rubber can be arbitrarily set according to various characteristics such as the resistance value and flexibility required for the inner layer 2.

For example, the proportion of the epichlorohydrin rubber is preferably 12 parts by mass or more and preferably 20 parts by mass or less with respect to 100 parts by mass of the total amount of the rubbers.

In addition, the proportion of CR is preferably 5 parts by mass or more and preferably 12 parts by mass or less with respect to 100 parts by mass of the total amount of the rubbers.

The proportion of the nonpolar diene rubber other than CR is the amount remaining after of the epichlorohydrin rubber, or the epichlorohydrin rubber and CR.

That is, the proportion of the nonpolar diene rubber may be set so that the total amount of the rubbers is 100 parts by mass when the proportion of the epichlorohydrin rubber or the epichlorohydrin rubber and CR is set to predetermined values within the above range.

<Crosslinking Component>

Regarding the crosslinking component, a combination of the crosslinking agent and crosslinking promoter the same as those used in the outer layer 4 is preferably used.

That is, regarding the crosslinking agent, a sulfur-based crosslinking agent, sulfur is particularly preferable. Regarding the crosslinking promoter to be combined with the sulfur-based crosslinking agent, it is preferable to use four types of a thiuram-based promoter, a thiazole-based promoter, a thiourea-based promoter, and a guanidine-based promoter in combination.

Proportions of the sulfur-based crosslinking agent, and four types of crosslinking promoters are preferably about the same as those in the outer layer 4.

<Ion Conducting Agent>

An ion conducting agent may be additionally added to the rubber composition for the inner layer 2.

When the ion conducting agent is added, it is possible to further improve ion conductivity of the rubber composition, and it is possible to further reduce the resistance value of the inner layer 2 itself.

The ion conducting agent is preferably a salt (ionic salt) of an anion having a fluoro group and a sulfonyl group in the molecule and a cation, similar to that used in the outer layer 4.

The proportion of the ion conducting agent is preferably about the same as that in the outer layer 4.

<Others>

Various additives may be additionally added to the rubber composition for the inner layer 2 as necessary.

Regarding the additive, the same additives used in the outer layer 4, for example, a crosslinking promoting aid, an acid acceptor, a filling agent, a plasticizer, a processing aid, a deterioration inhibitor, a scorching inhibitor, a lubricant, a pigment, an antistatic agent, a flame retardant, a neutralizing agent, a nucleating agent, and a co-crosslinking agent may be exemplified.

Regarding the filling agent, for example, one, two, or more types of zinc oxide, carbon black, silica, talc, calcium carbonate, magnesium carbonate, and aluminum hydroxide may be used.

In addition, conductive carbon black can be used as carbon black.

When conductive carbon black is used, electron conductivity can be imparted to the inner layer 2.

Regarding the conductive carbon black, for example, acetylene black and the like may be used.

<Preparation of Rubber Composition>

The rubber composition for the inner layer 2 including the components described above can be prepared in the same manner as in the related art.

That is, rubber is masticated. Next, components other than the crosslinking component are added and kneaded, and the crosslinking component is then finally added and kneaded to obtain a rubber composition for the inner layer 2.

For kneading, for example, a kneader, a Bunbury mixer, or an extruder can be used.

<<Production of Developing Roller 1>>

In order to produce the developing roller 1 shown in FIGS. 1A and 1B using rubber compositions for the inner layer 2 and the outer layer 4, for example, both rubber compositions are supplied to a 2-layer extruder, and co-extruded and molded into a cylindrical shape having a laminated 2-layer structure, and the whole is then cross-linked to form the inner layer 2 and the outer layer 4.

Alternatively, the rubber composition for the inner layer 2 is extruded and molded into a cylindrical shape and crosslinked to form the inner layer 2, a sheet of the rubber composition for the outer layer 4 is then wound around the outer circumferential surface 3, molded into a cylindrical shape by press molding and the like, and crosslinked to form the outer layer 4 integrated with the inner layer 2.

Next, the formed laminate of the inner layer 2 and the outer layer 4 is heated in an oven or the like and subjected to secondary crosslinking, and cooled and then polished so that it has a predetermined outer diameter, and thereby the roller main body 5 composed of the laminate is formed.

The thickness of the inner layer 2 can be arbitrarily set according to the structure, the size, and the like of an incorporation target image forming device.

In addition, while the thickness of the outer layer 4 can be arbitrarily set, it is preferably 0.1 mm or more and preferably 2 mm or less.

Regarding the polishing method, for example, various polishing methods such as dry traverse polishing can be used, and mirror-polishing may be performed at the end of the polishing process for finishing.

In this case, releasability of the outer circumferential surface 8 is improved so that the oxide film 9 is not formed or a synergistic effect resulting from formation of the oxide film 9 is provided. Therefore, it is possible to minimize adhesion of a toner more favorably and prevent contamination of the photoreceptor and the like effectively.

The shaft 7 can be inserted and fixed to the through-hole 6 at any time from after the cylindrical component that forms the roller main body 5 is cut and until after polishing.

However, after cutting, secondary crosslinking and polishing are preferably performed first while the shaft 7 is inserted into the through-hole 6. Therefore, it is possible to minimize warping and deformation of the roller main body 5 due to expansion and contraction during secondary crosslinking.

In addition, when polishing is performed while rotating around the shaft 7, it is possible to improve workability of the polishing and minimize deflection of the outer circumferential surface 8.

As described above, the shaft 7 is inserted into the through-hole 6 of the cylindrical component before secondary crosslinking using an adhesive having conductivity, and particularly, a conductive thermosetting adhesive, and then subjected to secondary crosslinking, or a shaft having an outer diameter larger than the inner diameter of the through-hole 6 may be press-fitted into the through-hole 6.

In the former case, a cylindrical component is subjected to secondary crosslinking due to heating in an oven and, and at the same time, a thermosetting adhesive is cured, and the shaft 7 is electrically connected and mechanically fixed to the roller main body 5.

In addition, in the latter case, press-fitting is performed, and at the same time, electrical connection and mechanical fixing are completed.

In addition, as described above, using both methods together, the shaft 7 may be electrically connected and mechanically fixed to the roller main body 5.

As described above, the oxide film 9 is preferably formed on the outer circumferential surface 8 of the roller main body 5 which is a surface of the outer layer 4 by emitting ultraviolet rays.

That is, since the oxide film 9 can be formed by simply emitting ultraviolet rays with a predetermined wavelength to the outer circumferential surface 8 of the roller main body 5 for a predetermined time, and oxidizing rubber constituting the vicinity of the outer circumferential surface 8, this is simple and efficient.

In addition, the oxide film 9 formed by emitting ultraviolet rays does not cause problems, for example, as in a coating film formed by applying a coating agent of the related art, and has excellent thickness uniformity and adhesion to the roller main body 5, and the like.

In order to oxidize the diene rubber in the rubber composition for the outer layer 4 with high efficiency and form the oxide film 9 having excellent functions described above, the wavelength of ultraviolet rays emitted is preferably 100 nm or more and 400 nm or less, and particularly preferably 300 nm or less.

In addition, the irradiation time is preferably 30 seconds or longer, particularly 1 minute or longer, and preferably 30 minutes or shorter, particularly 20 minutes or shorter.

However, the oxide film 9 may be formed by other methods, and may not be formed in some cases.

One or more optional intermediate layers may be interposed between the inner layer 2 and the outer layer 4.

However, in order to simplify the structure of the roller main body 5, as shown in FIGS. 1A and 1B, the roller main body 5 preferably has a 2-layer structure in which the inner layer 2 and the outer layer 4 are directly laminated.

The developing roller 1 of the disclosure can be incorporated into, for example, various image forming devices using electrophotography such as a laser printer, an electrostatic copying machine, a plain paper facsimile machine, and a multifunctional machine thereof and used.

EXAMPLES

The disclosure will be described below in detail based on examples, and comparative examples. However, the configuration of the disclosure is not necessarily limited to these examples.

Example 1

(Rubber Composition for Inner Layer 2)

Regarding the rubber, 15 parts by mass of GECO [Epion (registered trademark, commercially available from Osaka Soda Co., Ltd.) 301L, EO/EP/AGE=73/23/4 (molar ratio)], 40 parts by mass of IR [Nipol (registered trademark, commercially available from Zeon Corporation) IR2200, non-oil extended], 35 parts by mass of BR [UBEPOL (registered trademark, commercially available from Ube Industries, Ltd.) BR130B, non-oil extended], and 10 parts by mass of CR [Shoprene (registered trademark, commercially available from Showa Denko K.K.) WRT, non-oil extended] were used.

While masticating 100 parts by mass of the total amount of the rubbers using a Banbury mixer, the following components were added and kneaded.

TABLE 1

| Component | Parts by mass |
|---|---|
| Ionic salt | 1.0 |
| Crosslinking promoting aid | 2.5 |
| Acid acceptor | 3.0 |
| Filling agent | 3.0 |
| Processing aid | 0.5 |

Components in Table 1 are as follows. In addition, the parts by mass in the table are parts by mass with respect to 100 parts by mass of the total amount of the rubbers.

Ionic salt: potassium bis(trifluoromethanesulfonyl)imide, EF-N112, K-TFSI (commercially available from Mitsubishi Material Electronic Chemicals Co., Ltd.)

Crosslinking promoting aid: two types of zinc oxide (commercially available from Sakai Chemical Industry Co., Ltd.)

Filling agent: acetylene black, Denka Black (registered trademark, commercially available from Denka Co., Ltd.) powdery acid acceptor: hydrotalcites, DHT-4A (registered trademark, commercially available from Kyowa Chemical Industry Co., Ltd.)-2

Processing aid: zinc stearate, SZ-2000 (commercially available from Sakai Chemical Industry Co., Ltd.).

Next, while kneading was continued, the following crosslinking components were added and kneading was additionally performed to prepare a rubber composition for the inner layer 2.

TABLE 2

| Component | Parts by mass |
|---|---|
| Crosslinking agent | 1.05 |
| Promoter DM | 1.5 |
| Promoter TS | 0.5 |
| Promoter 22 | 0.3 |
| Promoter DT | 0.2 |

Components in Table 2 are as follows. In addition, the parts by mass in the table are parts by mass with respect to 100 parts by mass of the total amount of the rubbers.

Crosslinking agent: Golden flower 5% oil-filled fine sulfur powder (commercially available from Tsurumi Chemical Industry Co., Ltd.)

Promoter DM: di-2-benzothiazolyl disulfide, Nocceler (registered trademark, commercially available from Ouchi Shinko Chemical Industry) DM, thiazole-based promoter Crosslinking promoter TS: tetramethylthiuram monosulfide, Sanceler (registered trademark, commercially available from Sanshin Chemical Industry Co., Ltd.) TS, thiuram-based promoter.

Promoter 22: ethylene thiourea [Accelerator (registered trademark, commercially available from Kawaguchi Chemical Industry Co., Ltd.) 22-S, 2-mercaptoimidazoline]

Promoter DT: 1,3-di-o-tolylguanidine [Sanceler DT (commercially available from Sanshin Chemical Industry Co., Ltd.) guanidine-based promoter]

(Rubber Composition for Outer Layer 4)

Regarding the rubber, 30 parts by mass of GECO [(Epion 301L commercially available from Osaka Soda Co., Ltd, EO/EP/AGE=73/23/4 (molar ratio)], 60 parts by mass of SBR [JSR 1502 commercially available from JSR, non-oil extended] and 10 parts by mass of LIR [(Kaplan Liquid Rubber (registered trademark, commercially available from Kuraray Co., Ltd., LIR-50, number average molecular weight Mn: 54,000] were used.

While masticating 100 parts by mass of the total amount of the rubbers using a Banbury mixer, the following components were added and kneaded.

TABLE 3

| Component | Parts by mass |
|---|---|
| Ionic salt | 1.0 |
| Crosslinking promoting aid | 2.5 |
| Carbon black | 3.0 |
| Acid acceptor | 3.0 |
| Processing aid | 0.5 |

Components in Table 3 are as follows. In addition, the parts by mass in the table are parts by mass with respect to 100 parts by mass of the total amount of the rubbers.

Ionic salt: potassium bis(trifluoromethanesulfonyl)imide, EF-N112, K-TFSI (commercially available from Mitsubishi Material Electronic Chemicals Co., Ltd.)

Crosslinking promoting aid: two types of zinc oxide (commercially available from Sakai Chemical Industry Co., Ltd.)

Carbon black: Asahi #15 (commercially available from Asahi Carbon Co., Ltd.), amount of iodine absorbed: 11 mg/g Acid acceptor: hydrotalcites, DHT-4A-2 (commercially available from Kyowa Chemical Industry Co., Ltd.)

Processing aid: zinc stearate, SZ-2000 (commercially available from Sakai Chemical Industry Co., Ltd.)

Next, while kneading was continued, the following crosslinking components were added and kneading was additionally performed to prepare a rubber composition for the outer layer 4.

TABLE 4

| Component | Parts by mass |
|---|---|
| Crosslinking agent | 1.0 |
| Promoter DM | 1.5 |
| Promoter TS | 0.5 |
| Promoter 22 | 0.3 |
| Promoter DT | 0.2 |

Components in Table 4 are as follows. In addition, the parts by mass in the table are parts by mass with respect to 100 parts by mass of the total amount of the rubbers.

Crosslinking agent: Golden flower 5% oil-filled fine sulfur powder (commercially available from Tsurumi Chemical Industry Co., Ltd.)

Promoter DM: di-2-benzothiazolyl disulfide (Nocceler DM commercially available from Ouchi Shinko Chemical Industry), thiazole-based promoter Promoter TS: tetramethylthiuram monosulfide, Sanceler TS (commercially available from Sanshin Chemical Industry Co., Ltd.), thiuram-based promoter Promoter 22: ethylene thiourea [Accelerator 22-S (commercially available from Kawaguchi Chemical Industry Co., Ltd.), 2-mercaptoimidazoline] Promoter DT: 1,3-di-o-tolylguanidine [Sanceler DT (commercially available from Sanshin Chemical Industry Co., Ltd.), guanidine-based promoter]

(Production of Developing Roller)

The rubber composition for the inner layer 2 and the rubber composition for the outer layer 4 were supplied to a 2-layer extruder, and extruded and molded into a cylindrical shape having a 2-layer structure with an outer diameter of φ 16 mm and an inner diameter of φ 6.5 mm, and a cylindrical component with a thickness of 3.5 mm forming the inner layer 2, attached to a temporary shaft for crosslinking and crosslinked in a vulcanizer at 160° C. for 1 hour.

Next, the crosslinked cylindrical component was re-attached to the metal shaft 7 having an outer diameter of φ 7.5 mm with an outer circumferential surface to which a conductive thermosetting adhesive was applied and heated in an oven at 160° C. and bonded to the shaft 7.

Next, when both ends of the cylindrical component were shaped, the outer circumferential surface 8 was subjected to traverse polishing using a cylindrical polishing machine and then mirror-polished as a finish and finishing was performed so that the outer diameter became φ 16 mm, and the roller main body 5 which had a 2-layer structure including the inner layer 2 and the outer layer 4 and was integrated with the shaft 7 was formed.

The thickness of the outer layer 4 was about 0.1 to 2 mm.

Next, the formed outer circumferential surface 8 of the roller main body 5 was wiped with an alcohol, and then set in a UV irradiation device [PL21-200 commercially available from Sen Lights Co., Ltd.] in which a distance from the outer circumferential surface 8 to a UV lamp was set to 50 mm.

Then, while rotating around the shaft by 90°, ultraviolet rays with a wavelength 184.9 nm and 253.7 nm were emitted for 15 minutes, the oxide film 9 was formed on the outer circumferential surface 8, and thereby the developing roller 1 was produced.

Comparative Example 1

A rubber composition for the outer layer 4 was prepared in the same manner as in Example 1 except that, in place of SBR, the same amount of NBR [Nipol DN401LL (commercially available from Zeon Corporation), content of acrylonitrile: 18.0%] was used, and thereby a developing roller 1 was produced.

Comparative Example 2

A rubber composition for the outer layer 4 was prepared in the same manner as in Example 1 except that, in place of SBR, the same amount of CR [Shoprene WRT commercially available from Showa Denko K.K., non-oil extended] was used, and thereby a developing roller 1 was produced.

Comparative Example 3

A rubber composition for the outer layer 4 was prepared in the same manner as in Example 1 except that an amount of SBR was 40 parts by mass, and additionally, 20 parts by mass of the same NBR as used in Comparative Example 1 were added, and thereby a developing roller 1 was produced.

Comparative Example 4

A rubber composition for the outer layer 4 was prepared in the same manner as in Example 1 except that an amount of SBR was 40 parts by mass, and additionally, 20 parts by mass of the same CR as used in Comparative Example 2 were added, and thereby a developing roller 1 was produced.

Example 2

A rubber composition for the outer layer 4 was prepared in the same manner as in Example 1 except that an amount of SBR was 50 parts by mass, and additionally, 10 parts by mass of the same NBR as used in Comparative Example 1 were added, and thereby a developing roller 1 was produced.

Example 3

A rubber composition for the outer layer 4 was prepared in the same manner as in Example 1 except that an amount of SBR was 50 parts by mass, and additionally, 10 parts by mass of the same CR as used in Comparative Example 2 was added, and thereby a developing roller 1 was produced.

Example 4

A rubber composition for the outer layer 4 was prepared in the same manner as in Example 1 except that an amount of SBR was 62.5 parts by mass and an amount of LIR was 7.5 parts by mass, and thereby a developing roller 1 was produced.

Example 5

A rubber composition for the outer layer 4 was prepared in the same manner as in Example 1 except that an amount of SBR was 65 parts by mass and an amount of LIR was 5 parts by mass, and thereby a developing roller 1 was produced.

Comparative Example 5

A rubber composition for the outer layer 4 was prepared in the same manner as in Example 1 except that an amount of SBR was 70 parts by mass and no LIR was added, and thereby a developing roller 1 was produced.

Comparative Example 6

A rubber composition for the outer layer 4 was prepared in the same manner as in Example 1 except that, in place of LIR, 10 parts by mass of the same CR as used in Comparative Example 2 was added, and thereby a developing roller 1 was produced.

Example 6

A rubber composition for the outer layer 4 was prepared in the same manner as in Example 1 except that no carbon black was added, and thereby a developing roller 1 was produced.

Example 7

A rubber composition for the outer layer 4 was prepared in the same manner as in Example 1 except that an amount of carbon black was 5 parts by mass, and thereby a developing roller 1 was produced.

Comparative Example 7

A rubber composition for the outer layer 4 was prepared in the same manner as in Example 1 except that an amount of carbon black was 10 parts by mass, and thereby a developing roller 1 was produced.

Comparative Example 8

A rubber composition for the outer layer 4 was prepared in the same manner as in Example 1 except that, as carbon black, 5 parts by mass of Seast (registered trademark, commercially available from Tokai Carbon Co., Ltd.) SO having an amount of iodine absorbed of 44 mg/g was added, and thereby a developing roller 1 was produced.

Comparative Example 9

A rubber composition for the outer layer 4 was prepared in the same manner as in Example 1 except that, as carbon black, 5 parts by mass of Seast 3 (commercially available from Tokai Carbon Co., Ltd.) having an amount of iodine absorbed of 80 mg/g was added, and thereby a developing roller 1 was produced.

Comparative Example 10

A rubber composition for the outer layer 4 was prepared in the same manner as in Example 1 except that, as carbon black, 5 parts by mass of Denka Black powder form (commercially available from Denka Co., Ltd.) having an amount of iodine absorbed of 92 mg/g was added, and thereby a developing roller 1 was produced.

The developing rollers 1 produced in the above examples and comparative examples were subjected to the following tests and characteristics thereof were evaluated.

<Measurement of Durable Image Density>

The developing rollers produced in the example and the comparative examples were incorporated into a laser printer [HL-2240D commercially available from Brother Industries, Ltd.], and immediately after 3,000 images with a density of 1% were continuously formed on plain paper under an environment with a temperature of 23.5° C. and a relative humidity of 55%, one black solid image of 3 cm square was formed.

Then, at five arbitrary points on the formed black solid image, the image density was measured using a reflection densitometer (commercially available from Videojet X-Rite), and an average value thereof was obtained and determined as an durable image density. A durable image density of 1.30 or more was determined to be satisfactory.

(Extrusion Moldability)

The extruded surfaces of the cylindrical components produced by extruding and molding the rubber compositions for the outer layer 4 prepared in the examples and comparative examples, that is, the outer circumferential surfaces of the cylindrical component before polishing after extruding and molding, and the inner circumferential surface of the through-hole, were observed, and extrusion moldability was evaluated according to the following criteria.

○: No irregularities were observed on the extruded surface.

Δ: Although some irregularities were observed on the extruded surface, it was a practical level.

x: Severe irregularities were observed on the extruded surface.

In addition, the developing rollers produced in the example and the comparative examples were incorporated into the laser printer the same as above, and immediately after 30 images with a density of 1% were continuously formed on sheets of plain paper under an environment with a temperature of 23.5° C. and a relative humidity of 55%, and one black solid image of 3 cm square was formed.

Then, the formed black solid image was visually observed, and it was evaluated as favorable "○" when no density irregularities due to the irregular extruded surface were observed, and evaluated as poor "x" when irregularities were observed.

The above results are shown in Table 5 to Table 7.

TABLE 5

| | | | Example 1 | Comparative Example 1 | Comparative Example 2 | Comparative Example 3 | Comparative Example 4 | Example 2 |
|---|---|---|---|---|---|---|---|---|
| Parts by mass | GECO | | 30 | 30 | 30 | 30 | 30 | 30 |
| | SBR | | 60 | — | — | 40 | 40 | 50 |
| | LIR | | 10 | 10 | 10 | 10 | 10 | 10 |
| | NBR | | — | 60 | — | 20 | — | 10 |
| | CR | | — | — | 60 | — | 20 | — |
| Carbon black | Amount of iodine absorbed (mg/g) | | 11 | 11 | 11 | 11 | 11 | 11 |
| | Parts by mass | | 3 | 3 | 3 | 3 | 3 | 3 |
| Evaluation | Durable image density | Numerical value | 1.38 | 0.85 | 0.91 | 1.05 | 1.12 | 1.32 |
| | | Evaluation | ○ | x | x | x | x | ○ |
| | Extruded surface | | ○ | ○ | ○ | ○ | ○ | ○ |
| | Uneven density | | ○ | ○ | ○ | ○ | ○ | ○ |

TABLE 6

| | | Example 3 | Example 4 | Example 5 | Comparative Example 5 | Comparative Example 6 | Example 6 |
|---|---|---|---|---|---|---|---|
| Parts by mass | GECO | 30 | 30 | 30 | 30 | 30 | 30 |
| | SBR | 50 | 62.5 | 65 | 70 | 60 | 60 |
| | LIR | 10 | 7.5 | 5 | — | — | 10 |
| | NBR | — | — | — | — | — | — |
| | CR | 10 | — | — | — | 10 | — |

TABLE 6-continued

| | | | Example 3 | Example 4 | Example 5 | Comparative Example 5 | Comparative Example 6 | Example 6 |
|---|---|---|---|---|---|---|---|---|
| Carbon black | Amount of iodine absorbed (mg/g) | | 11 | 11 | 11 | 11 | 11 | 11 |
| | Parts by mass | | 3 | 3 | 3 | 3 | 3 | — |
| Evaluation | Durable image density | Numerical value | 1.32 | 1.35 | 1.37 | 1.35 | 1.35 | 1.39 |
| | | Evaluation | ○ | ○ | ○ | ○ | ○ | ○ |
| | Extruded surface | | ○ | ○ | Δ | x | x | ○ |
| | Uneven density | | ○ | ○ | ○ | x | x | ○ |

TABLE 7

| | | | Example 7 | Comparative Example 7 | Comparative Example 8 | Comparative Example 9 | Comparative Example 10 |
|---|---|---|---|---|---|---|---|
| Parts by mass | GECO (parts by mass) | | 30 | 30 | 30 | 30 | 30 |
| | SBR (parts by mass) | | 60 | 60 | 60 | 60 | 60 |
| | LIR (parts by mass) | | 10 | 10 | 10 | 10 | 10 |
| | NBR | | — | — | — | — | — |
| | CR | | — | — | — | — | — |
| Carbon black | Amount of iodine absorbed (mg/g) | | 11 | 11 | 44 | 80 | 92 |
| | Parts by mass | | 5 | 10 | 5 | 5 | 5 |
| Evaluation | Durable image density | Numerical value | 1.35 | 1.28 | 1.22 | 1.21 | 1.23 |
| | | Evaluation | ○ | x | x | x | x |
| | Extruded surface | | ○ | ○ | ○ | ○ | ○ |
| | Uneven density | | ○ | ○ | ○ | ○ | ○ |

Based on the results of Examples 1 to 7 and Comparative Examples 7 to 10 in Table 5 to Table 7, it was found that, when the outer layer 4 was formed of a crosslinked product of the rubber composition in which an epichlorohydrin rubber, a nonpolar diene rubber, and LIR were included and carbon black was not included or carbon black having an amount of iodine absorbed of 40 mg/g or less was included in a proportion of less than 10 parts by mass with respect to 100 parts by mass of the total amount of the rubbers, it was possible to minimize a gradual decrease in the image density of particularly a black solid part even if image formation was repeated.

However, based on the results of Examples 1 to 7, and Comparative Examples 1 to 6, it was found that, in order to obtain the above effects, it was necessary to exclude the polar diene rubber or to limit the proportion of the polar diene rubber to less than 20 parts by mass with respect to 100 parts by mass of the total amount of the rubbers.

In addition, particularly based on the results of Examples 1 and 7, the proportion of the carbon black was preferably 1 part by mass or more and preferably 5 parts by mass or less within the above range with respect to 100 parts by mass of the total amount of the rubbers.

Based on the results of Examples 1 to 6, it was found that the proportion of the LIR was preferably 5 parts by mass or more, particularly 7 parts by mass or more, and preferably 15 parts by mass or less, particularly 12 parts by mass or less within the above range with respect to 100 parts by mass of the total amount of the rubbers.

In addition, it was found that the proportion of the epichlorohydrin rubber was preferably 20 parts by mass or more and 40 parts by mass or less with respect to 100 parts by mass of the total amount of the rubbers.

What is claimed is:

1. A developing roller comprising a roller main body, wherein the roller main body includes a cylindrical inner layer constituted by an elastic material and an outer layer constituted by an elastic material laminated on an outer circumferential surface of the inner layer, and wherein the outer layer is constituted by a crosslinked product of a rubber composition in which an epichlorohydrin rubber, a nonpolar diene rubber, and a liquid isoprene rubber are included as rubbers, and polar diene rubbers are not included or polar diene rubbers are included in a proportion of less than 20 parts by mass with respect to 100 parts by mass of the total amount of the rubbers, and carbon black is not included or carbon black having an amount of iodine absorbed of 40 mg/g or less is included in a proportion of less than 10 parts by mass with respect to 100 parts by mass of the total amount of the rubbers.

2. The developing roller according to claim 1, wherein a proportion of the carbon black is 1 part by mass or more and 5 parts by mass or less with respect to 100 parts by mass of the total amount of the rubbers.

3. The developing roller according to claim 2, wherein a proportion of the liquid isoprene rubber is 5 parts by mass or more and 15 parts by mass or less with respect to 100 parts by mass of the total amount of the rubbers.

4. The developing roller according to claim 2, wherein a proportion of the epichlorohydrin rubber is 20 parts by mass or more and 40 parts by mass or less with respect to 100 parts by mass of the total amount of the rubbers.

5. The developing roller according to claim 2, wherein the nonpolar diene rubber is at least one selected from the group consisting of isoprene rubber, butadiene rubber, and styrene butadiene rubber.

6. The developing roller according to claim 1, wherein a proportion of the liquid isoprene rubber is 5 parts by mass or more and 15 parts by mass or less with respect to 100 parts by mass of the total amount of the rubbers.

7. The developing roller according to claim 6, wherein a proportion of the epichlorohydrin rubber is 20 parts by mass or more and 40 parts by mass or less with respect to 100 parts by mass of the total amount of the rubbers.

8. The developing roller according to claim 6, wherein the nonpolar diene rubber is at least one selected from the group consisting of isoprene rubber, butadiene rubber, and styrene butadiene rubber.

9. The developing roller according to claim 1, wherein a proportion of the epichlorohydrin rubber is 20 parts by mass or more and 40 parts by mass or less with respect to 100 parts by mass of the total amount of the rubbers.

10. The developing roller according to claim 9, wherein the nonpolar diene rubber is at least one selected from the group consisting of isoprene rubber, butadiene rubber, and styrene butadiene rubber.

11. The developing roller according to claim 1, wherein the nonpolar diene rubber is at least one selected from the group consisting of isoprene rubber, butadiene rubber, and styrene butadiene rubber.

* * * * *